United States Patent [19]

Andersen

[11] 4,138,114

[45] Feb. 6, 1979

[54] SLOT MACHINES

[76] Inventor: Kurt H. Andersen, Gertrud Rasks Vej 3, 8200 Aarhus N, Denmark

[21] Appl. No.: 510,993

[22] Filed: Oct. 1, 1974

[51] Int. Cl.[2] ..... A63F 5/04

[52] U.S. Cl. ..... 273/143 R; 250/557

[58] Field of Search ..... 273/138 A, 145 R, 145 A, 273/145 B, 145 C, 145 D, 145 E, 142 A, 142 B, 141 A; 35/48 B, 9 B, 9 H, 4; 250/557, 568, 570

[56] References Cited

U.S. PATENT DOCUMENTS

| | | | |
|---|---|---|---|
| 2,026,329 | 12/1935 | Tauschek | 250/557 X |
| 2,580,270 | 12/1951 | Badgley et al. | 250/557 X |
| 2,820,907 | 1/1958 | Silverman | 250/557 X |

FOREIGN PATENT DOCUMENTS

| | | | |
|---|---|---|---|
| 41594 | 2/1971 | Australia | 273/138 A |

*Primary Examiner*—Richard C. Pinkham
*Assistant Examiner*—Arnold W. Kramer
*Attorney, Agent, or Firm*—Craig and Antonelli

[57] ABSTRACT

A machine of the type in which a number of wheels are brought to rotate and to stop in different positions, and in which an arrangement is provided for detecting the individual stop positions of the wheels and for controlling a dispensing mechanism so as to cause release of different numbers of articles in response to the wheels stopping in different characteristic mutual positions, corresponding to the showing of certain symbols in a window of the machine. The detecting arrangement is constituted by touchfree, preferably photoelectric sensing means which cooperate with either the wheels or with movable levers operable to assume positions indicative of the respective stop positions of the wheels so as to be able to read the wheel stop positions in logic terms and supply, a reading signal to a control unit for actuating the dispensing mechanism when the readings of all wheel stop positions correspond to one of the characteristic combinations of stop positions.

7 Claims, 4 Drawing Figures

SLOT MACHINES

The present invention relates to machines of the type in which a number of wheels are brought to rotate and to stop in different positions, and in which means are provided for sensing the individual stop positions of the wheels and for controlling a dispensing mechanism so as to cause release of different numbers of items in response to the wheels stopping in different characteristic mutual positions. More specifically the invention relates to the said sensing means, and at this place there will be no need, therefore, to describe the wheel start means and the dispensing mechanism in more detail.

Normally each of the wheels have an exterior drum surface on which there is printed a circumferential row of characters or pictures, and at one side of the wheel or drum there is provided a corresponding number of notches which are engageable by a stop pawl member with the stop pawl member for each wheel or drum being actuated a different time interval after start of the wheel so as to stop the wheel by engaging with one of the notches. The notches belonging to the different characters or pictures are provided at different radial distances from the center of the wheel, and means are provided for sensing how far the pawl member is moved towards the wheel center when it is stopped by its engagement with the particular notch.

In the prior art it has been customary to have the pawl member mounted on a pivotable lever comprising a switch element moving along an arched row of stationary switch terminals so as to selectively short circuit the terminals in any given angular position of the said lever corresponding to a given stop position of said wheel. Though this arrangement may work satisfactorily there should nevertheless for each wheel be provided the necessary number of switch terminals, so the construction and the wiring becomes expensive, and of course the risk of failure increases with the number of mechanical switches.

It is the purpose of this invention to provide a machine in which the stop position of the single wheels can be detected in a simplified and safer manner.

According to the invention the stop positions of the wheels are detected by means of touchfree, preferably photoelectric sensing means which cooperate with either the wheels or the pivotable levers so as to be able to produce a number of logic signal combinations indicative of the respective stop positions. It will be appreciated that a simple and reliable arrangement is hereby obtainable. It should be mentioned that in many connections it is known in the art to effect position detection by touchfree, logic reading means, but until now it has not been suggested to take advantage of this technique in machines for facilitating both the stop detection of each wheel and the detection of a predetermined combination of stop positions being reached.

Figure 1:
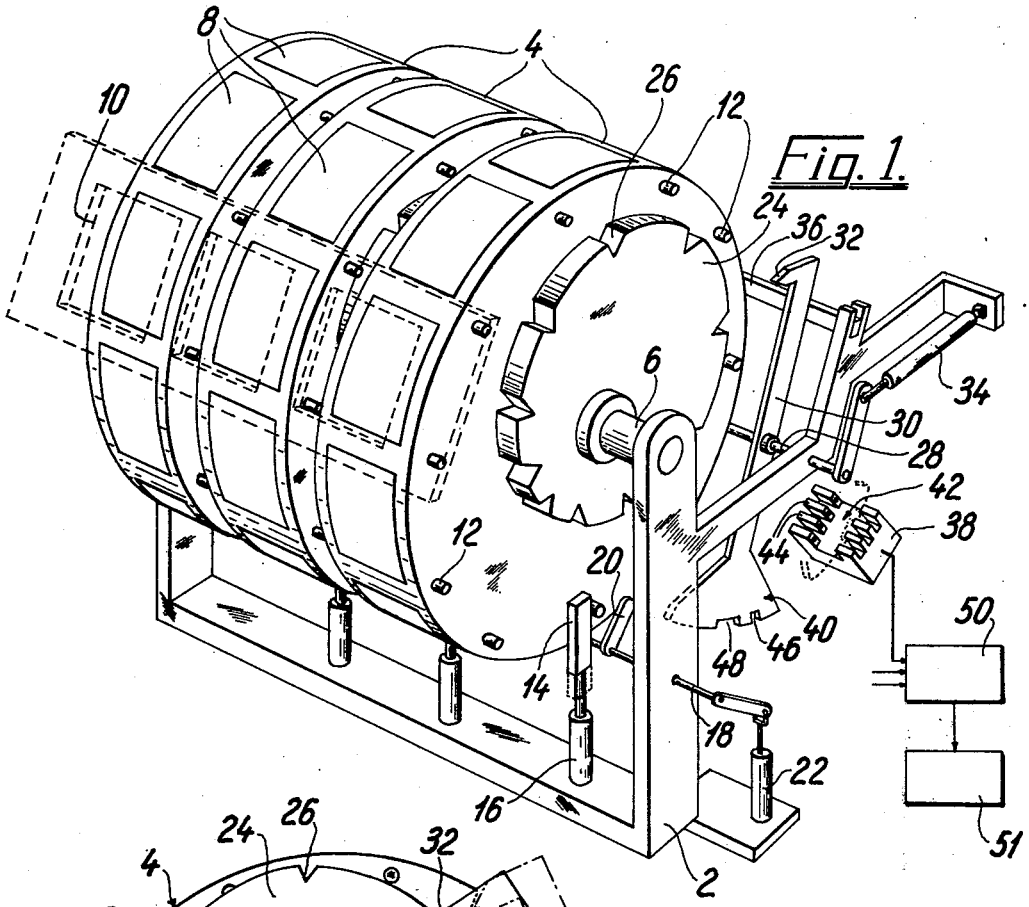
Figure 2:
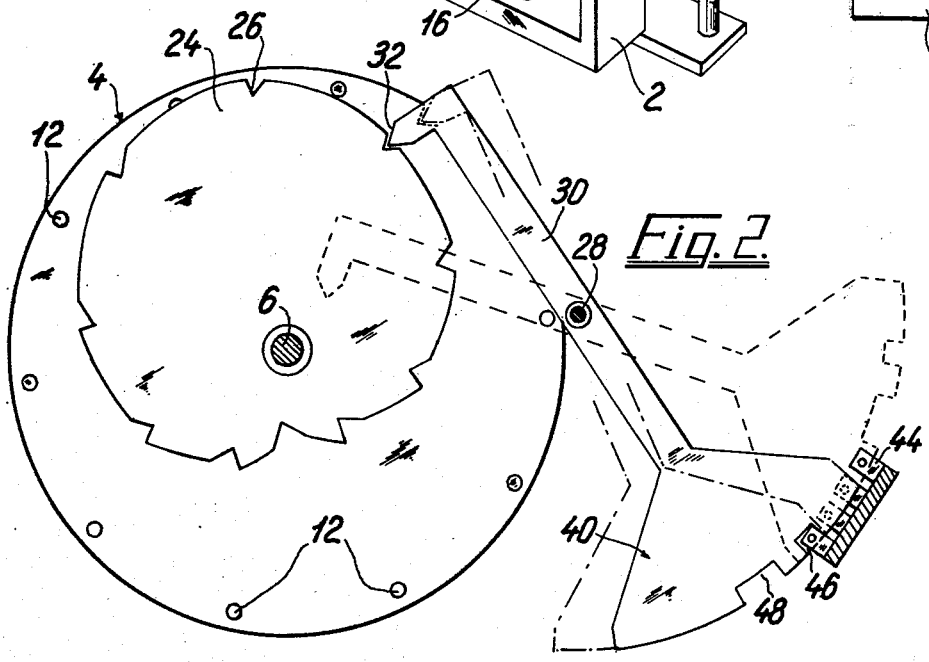
Figure 3:
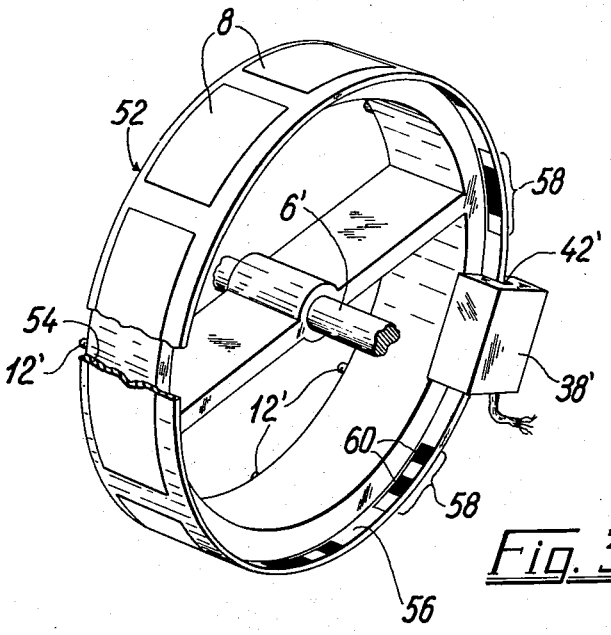
Figure 4:
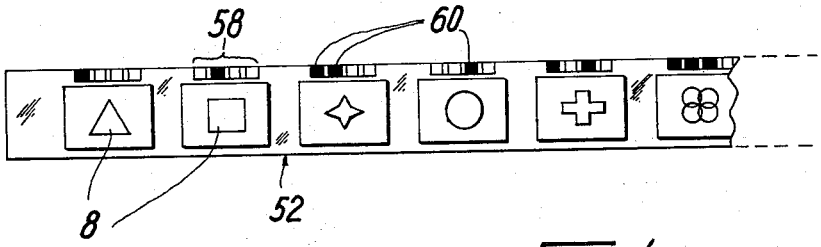

In the following, by way of examples, the invention is described in more detail with reference to the accompanying drawing, in which:

FIG. 1 is a schematic perspective view of an indicator wheel of a machine provided with a position sensing arrangement according to the invention, FIG. 2 is a plane view of the sensing means, FIG. 3 is a perspective view of a wheel with associated sensing means according to another — and preferred — embodiment of the invention, while FIG. 4 is a plane view of a symbol strip to be mounted on a wheel according to FIG. 3.

In FIG. 1 is shown a carrier chassis 2 for the wheel unit of a machine. The unit comprises three drum-like wheels 4 mounted freely rotable on a shaft 6. On the outer peripheral surface of the wheels is printed or otherwise provided an annular row of symbols 8, one transverse row of these symbols being visible through a window 10 in the cabinet of the machine. As well known, the wheels should be operable to be started all at the same time by the player operating an actuator handle, and thereafter the wheels are stopped individually by manual or automatic means. These start and stop means are known in different designs, and since they form no part of the present invention they will be described briefly only, and in the drawing they are shown very schematically.

On the side of each wheel 4 is provided a peripheral row of abutments 12 corresponding to the number of symbols 8 on the wheel, and underneath each wheel is provided a stop member 14 operable to be raised and lowered by suitable control means such as a cylinder 16. The member 14, therefore, is operable to stop the rotation of the wheel. The start mechanism may comprise a shaft 18 having a rigid radial finger 20 located underneath each of the three wheels and being rotatable e.g. by means of a cylinder 22 so as to cause the fingers 20 to be swung from the retracted position shown, in which they allow the wheels to rotate, against the lower abutment 12. When the stop members 14 are lowered the wheels will be started by the impact of the fingers 20 on the abutments 12, and the fingers 20 are rapidly swung away from the path of movement of the abutments 12. Normally the stop members are thereafter actuated sequentially in order to stop the wheels.

For detecting the stop positions of the wheels there is on each wheel provided an eccentric disc member 24 having a row of peripheral notches 26 each corresponding to a particular stop position of the wheel and all being located in mutually different distances from the centre of the wheel. Behind the wheels 4 is mounted a transverse shaft 28 carrying three pivotable levers 30, one for each wheel 4, the levers having an upper pawl nose portion 32 which is swingable into engagement with that of the notches 26 which have stopped in the path of movement of the nose 32. The levers 30 are frictionally held on the shaft 28 so that when the shaft is rotated counterclockwise, e.g. by means of a cylinder 34, the levers 30 will all be swung to engage their respective notches 26 also if these are not located in the same distances from the shaft 6. Thus, the angular positions of the levers will be indicative of the stop positions of the wheels, and as mentioned it has been normal practice to detect these positions by means of each lever cooperating with an arcuate row of switch terminals. When the stop positions have thus been detected for production of a possible control signal to the dispensing mechanism the shaft 28 is rotated clockwise so as to return the levers to their initial positions in which they are lined up against a stop bar 36.

According to the present invention the levers 30 do not cooperate with mechanical switch terminals, but with a touchfree logic sensor unit 38 mounted stationarily on the machine chassis in such a position that the lower edge portion 40 of a plate at the lower end of the lever 30 is receivable in a slot 42 of the unit 38. At one side of this slot is provided a number of lamps, and at the other side is provided a corresponding number of photocells 44. The edge portion 40 is provided with a narrow notch 46 and a wider notch 48.

As most clearly shown in FIG. 2 the notches 46 and 48 are placed in such a manner that for each different stop position of a particular wheel the associated lever 30 will assume an angular position in which a specific logic combination of light/no light on the single photo cells 44 is defined, and in this manner the detector unit 38 of each wheel will supply its logic reading to a control unit 50, from which a control signal is sent to the dispensing mechanism 51 when the readings correspond to a predetermined position of the wheels. The details of how to produce the different logic readings in accordance with the different positions of the levers 30 will not be further described, since they will present no problems to those skilled in the art of logic reading.

The detector arrangement shown in FIGS. 1 and 2 will be applicable in many already existing slot machines in which pivot levers are used for the stop position detection. Instead of pivot levers, of course, other movable feeler means such as a radially reciprocable rod may be used for detecting the radial distance of the selected notch or abutment 26 from the shaft 6. The detector means may be used also as stop means instead of the special stop members 14.

FIG. 3 shows a wheel 52 in a preferred embodiment of the invention, this wheel being usable together with other similar wheels in principally the same manner as in FIG. 1, i.e. with the same support, start and stop arrangements. The abutment members 12 of FIG. 1 are designated 12' in FIG. 3. To the outer wheel or drum surface is secured a strip 54 of flexible plastics on which the symbols 8 are printed. An edge portion 56 of the strip 54 projects beyond the edge of the wheel and is of a generally transparent character. The edge portion 56 extends through a slot 42' in a stationary reader unit 38' similar to the unit 38 in FIG. 1. Each symbol 8 on the strip 54 has an identification marking 58 on the edge portion 56, these markings consisting of non-transparent area portions 60 arranged so as to define a binary coding individual for each single marking 58. Thus, when the wheel is brought to stop, the marking 58 belonging to the symbol appearing in the window of the machine wll be situated in the reading unit 38', whereby the stop position of the wheel will be safely detected.

The edge portion 56 could represent a rigid flange portion of the wheel itself, if the transparent portions of the markings 58 are made as notches in this flange. It is advantageous, however, that the markings 58 be printed on the strip 54, as also shown in FIG. 4, since it is then very easy to change the predetermined combinations of stop positions simply by mounting another strip on the wheel, and the wheels should not be precisely machined for providing the notches.

It will be understood that the invention is in no way limited to the embodiments shown. In the arrangement according to FIG. 3 the annular row of binary markings 58 may be placed wherever convenient on the wheel or on the strip 54. The lamp or lamps of the reader unit 38' can be placed inside the edge portion rigidly supported by the shaft 6', and the photo sensor part of the unit can be held as an entirely separate part outside the edge portion whereby the unit 38' will not require any spacing between the wheels. Instead of using transparent/non-transparent markings it will be possible, as well known, to use reflecting/non-reflecting markings whereby the light source and the photo sensors may be placed at the same side of the marking carrying element. Even magnetic/non-magnetic markings could be used in connection with switches responsive to magnetism, or generally any convenient touchfree code reading system. It should be mentioned that the single code areas of the markings 58 should not necessarily be placed in a continuous row, when they are only positioned correctly relatively to the positions of the single photo sensors; theoretically, therefore, four photo sensors could be placed with a mutual spacing of e.g. 90° along the annular row of markings, when the single code areas are placed correspondingly.

What is claimed is:

1. A machine comprising: a chassis, a plurality of rotary indicator members, a shaft means for rotatably supporting said plurality of indicator members mounted in said chassis, each of said indicator members being provided with an annular row of symbols, actuator means for starting the indicator members to rotate individually, stop means for stopping the rotation of the respective indicator members, a position indicator means associated with each indicator member for providing an indication of the respective stop positions of the indicator members, detector means associated with each of said indicator members for selectively detecting the respective indicator means of the indicator members thereby indicating the actual stop position of a respective indicator member, a further indicator means for indicating the occurrence of a predetermined combination of symbols on the respective indicator members in the stopped position, logic control means connected with said detector means and said further indicator means for providing a control output signal to said further indicator means in response to said detector means detecting the predetermined combination of symbols, said annular row of symbols being provided on a carrier of sheet material, said sheet material carrier forming an independent element removably secured to the respective indicator members, said indicator means for indicating the respective stop positions of the indicator members being provided on said sheet material carrier.

2. A machine according to claim 1, in which each of said indicator members is fashioned as a drumlike wheel having an outer cylindrical peripheral surface, said sheet material carrier being fashioned as a strip mounted as a cylindrical ring member on said outer peripheral surface of each wheel, said indicator means for indicating the respective stop positions including logic characters provided on said strips.

3. A machine according to claim 2, characterized in that the logic characters consist of sub areas having one of light transparent and light reflecting properties provided along one edge of the respective strips.

4. A machine according to claim 1, in which said rotary indicator members are made as drumlike wheels having a cylindrical peripheral outer surface, and in which said sheet material carrier is fashioned as a sheet material strip mounted as a cylindrical ring member on said outer surface.

5. A machine according to claim 4, in which said sheet material strip is mounted on the respective drumlike wheel so as to project laterally beyond a side edge of the respective wheels, said indicator means for indicating the stop positions being provided on said sheet material strip along the laterally projecting portion thereof.

6. A machine according to claim 1, in which said indicator means for indicating the respective stop positions of the indicator members includes a plurality of distinctive sub-areas arranged on said sheet material carrier to form groups of photoelectrically readable logic characters.

7. A machine according to claim 6, in which the sheet material carrier is generally transparent, and in which said logic characters are defined by area portions printed so as to be less transparent than the sheet material itself.

* * * * *